US010501229B2

(12) United States Patent
Mentasti Granelli

(10) Patent No.: US 10,501,229 B2
(45) Date of Patent: Dec. 10, 2019

(54) LID FOR CONTAINERS OF SUBSTANCES AND CONTAINER OF SUBSTANCES COMPRISING SAID LID

(71) Applicants: Kerry Mentasti Granelli, London (GB); INTERNATIONAL PATENTS AND BRANDS CORPORATION, Oficina (PA)

(72) Inventor: Kerry Mentasti Granelli, London (GB)

(73) Assignee: INTERNATIONAL PATENTS AND BRANDS CORPORATION, Oficina (PA)

( * ) Notice: Subject to any disclaimer, the term of this patent is extended or adjusted under 35 U.S.C. 154(b) by 20 days.

(21) Appl. No.: 15/110,715

(22) PCT Filed: Jan. 7, 2015

(86) PCT No.: PCT/IB2015/050115
§ 371 (c)(1),
(2) Date: Jul. 8, 2016

(87) PCT Pub. No.: WO2015/104659
PCT Pub. Date: Jul. 16, 2015

(65) Prior Publication Data

US 2016/0325880 A1 Nov. 10, 2016

(30) Foreign Application Priority Data

Aug. 1, 2014 (IT) ..... UD2014A0003
Aug. 22, 2014 (IT) ..... UD2014A0145

(51) Int. Cl.
*B65D 17/34* (2006.01)
*B65D 17/32* (2006.01)
*B65D 17/28* (2006.01)

(52) U.S. Cl.
CPC ..... *B65D 17/4014* (2018.01); *B65D 17/4012* (2018.01); *B65D 2517/007* (2013.01);
(Continued)

(58) Field of Classification Search
CPC ..... B65D 17/165; B65D 17/166; B65D 2517/0013; B65D 2517/0016;
(Continued)

(56) References Cited

U.S. PATENT DOCUMENTS 3,303,959 A 2/1967 Brown
3,386,613 A 6/1968 Traynor
(Continued)

FOREIGN PATENT DOCUMENTS

EP 1 044 886 A1 10/2000
WO WO-2009/030526 A1 3/2009
WO WO-2011/001273 A1 1/2011

OTHER PUBLICATIONS

Communication Relating to the Results of the Partial International Search for PCT/IB2015/050115.
(Continued)

*Primary Examiner* — Gideon R Weinerth
(74) *Attorney, Agent, or Firm* — Marshall, Gerstein & Borun LLP

(57) ABSTRACT

A lid for a container made of metal and able to contain a substance, it comprises a closing element defined by a line of incision provided with a front portion, an opening lever disposed astride the line of incision and comprising a fulcrum front end disposed at the front of the front portion, and an intermediate region provided with a flexible tongue attached to the closing element, a mechanical element configured to attach the flexible tongue mechanically to the closing element. The mechanical element is disposed essentially tangent to the front portion of the line of incision.

27 Claims, 9 Drawing Sheets

(52) U.S. Cl.
CPC ..... *B65D 2517/0013* (2013.01); *B65D 2517/0016* (2013.01); *B65D 2517/0029* (2013.01); *B65D 2517/0032* (2013.01); *B65D 2517/0062* (2013.01); *B65D 2517/0077* (2013.01); *B65D 2517/0082* (2013.01)

(58) Field of Classification Search
CPC .... B65D 2517/0029; B65D 2517/0032; B65D 2517/0062; B65D 2517/007; B65D 2517/0077; B65D 2517/0082; B65D 17/4012; B65D 17/4011; B65D 47/106; B65D 2517/0094; B65D 2517/0089; B65D 2517/0092; B65D 2517/0071; B65D 2205/00; Y10S 220/906
USPC ..... 220/269, 270, 273, 271, 906, 712; D9/438
See application file for complete search history.

(56) References Cited

U.S. PATENT DOCUMENTS 3,442,416 A * 5/1969 Nicholson ..... B65D 17/165 220/269
3,450,300 A * 6/1969 Saunders ..... B65D 17/163 220/273
3,462,042 A * 8/1969 Stolle ..... B65D 17/165 220/269
3,478,917 A 11/1969 Rouse et al.
3,480,175 A 11/1969 Khoury
3,593,877 A * 7/1971 Khoury ..... B65D 17/163 220/273
3,618,816 A * 11/1971 Brown ..... B65D 17/165 220/273
3,637,106 A * 1/1972 Brown ..... B21D 51/383 220/273
3,720,349 A 3/1973 Brown
3,762,596 A * 10/1973 Henning ..... B65D 17/163 220/273
3,773,210 A 11/1973 Radtke
3,828,517 A 8/1974 Johnson
3,870,001 A * 3/1975 Brown ..... B21D 51/383 413/13
3,891,117 A * 6/1975 Dragomier ..... B65D 17/163 220/270
3,900,128 A * 8/1975 Brown ..... B21D 51/383 220/269
4,024,981 A 5/1977 Brown
4,042,144 A * 8/1977 Henning ..... B65D 17/163 220/273
4,043,479 A * 8/1977 Khoury ..... B65D 17/163 220/271
4,084,722 A * 4/1978 Rosynek ..... B65D 17/165 220/270
4,394,927 A * 7/1983 Zysset ..... B65D 17/163 220/273
4,397,403 A * 8/1983 Guimarin ..... B65D 17/165 220/269
4,399,925 A * 8/1983 Fundom ..... B65D 17/165 220/269
4,503,989 A 3/1985 Brown et al.
4,524,879 A * 6/1985 Fundom ..... B65D 17/165 220/273
4,596,342 A * 6/1986 Zysset ..... B65D 17/163 220/273
5,129,541 A 7/1992 Voigt et al.
5,145,086 A * 9/1992 Krause ..... B65D 17/165 220/268
5,224,618 A 7/1993 Garbiso
5,292,022 A * 3/1994 Blanco ..... B65D 17/166 220/257.1
5,411,159 A * 5/1995 Fan ..... B65D 17/165 220/265
5,738,237 A * 4/1998 McEldowney ..... B21D 51/383 220/269
5,813,811 A * 9/1998 Saunders ..... B21D 51/383 220/269
5,934,498 A * 8/1999 Jordan ..... B65D 17/165 220/270
2007/0108208 A1 5/2007 Dickie
2011/0186575 A1* 8/2011 Dunwoody ..... B65D 17/163 220/270
2012/0175371 A1* 7/2012 Consonni ..... B65D 17/165 220/269
2015/0144633 A1* 5/2015 Gailly ..... B65D 17/163 220/272
2016/0325880 A1* 11/2016 Mentasti Granelli ..... B65D 17/165
2017/0113835 A1* 4/2017 Mitchell ..... B65D 17/165

OTHER PUBLICATIONS

International Search Report and Written Opinion for PCT/IB2015/050115, dated Jun. 3, 2015.

* cited by examiner

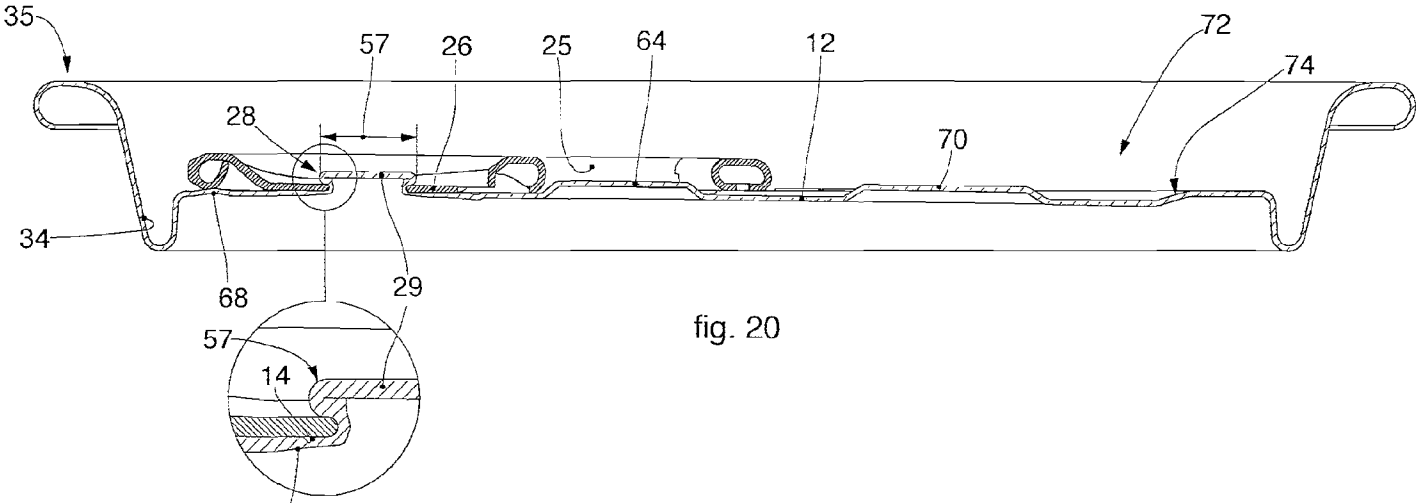
fig. 20
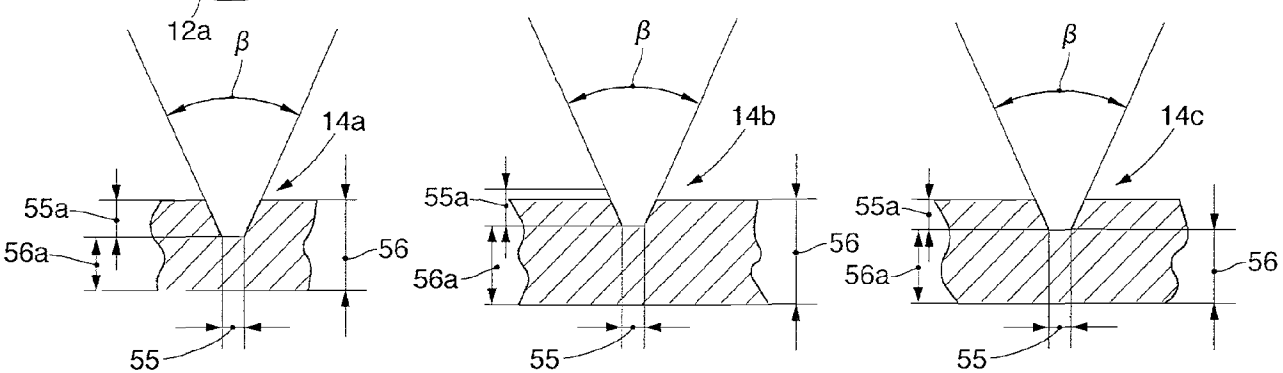
fig. 21a
fig. 21b
fig. 21c

LID FOR CONTAINERS OF SUBSTANCES AND CONTAINER OF SUBSTANCES COMPRISING SAID LID

FIELD OF THE INVENTION

The present invention concerns lids and containers equipped with said lids, which are normally used to contain substances, in particular but not exclusively, substances that can be eaten/drunk by humans or animals, for example drinks, food stuffs in general, food supplements, pharmaceutical substances, cosmetic products. These substances can be in fluid or liquid form, or also solid, for example in grains or powder or other.

The lid according to the present invention can also be used to make air-tight containers for special products, such as seeds, laboratory products, chemical products or others.

In particular, in the present description we shall refer to lids, and corresponding containers comprising said lids, advantageously but not exclusively made of aluminum, wherein a closing or stopper element is provided that hermetically closes a delivery aperture. The closing element is initially an integral part of the lid and subsequently, when it is at least partly pulled, causes the formation of said delivery aperture, remaining integrated with the closing element ("stay-on-tab"). According to a variant, the closing element is completely separated from the lid during opening for delivery, creating an exit aperture or compartment in the surface of the lid.

In particular, the present invention concerns lids, and the containers equipped with said lids, wherein the closing element enters inside the container at no stage of the pulling and opening step; that is, the invention concerns hygienic lids and containers or, more particularly, ones that do not cause contamination.

Depending on what they have to contain, the containers according to the present invention can have the internal surface made of metal, or the internal surface can have a protective film of material, coherent and compatible with the content, or materials coherent and compatible with the content that prevent contact between the content and the external container.

BACKGROUND OF THE INVENTION

Documents WO-A-2009/030526 and WO-A-2011/001273, in the name of the present Applicant, are known. They concern lids and containers provided with said lids to contain a substance, in which there is a pull-open closing element, which remains integral with the lid once opened ("stay-on tab"). In these known documents, a rivet is provided that connects an opening lever to the closing element: the rivet is disposed inside a line of incision that defines said closing element.

U.S. Pat. No. 4,503,989 is also known, which describes a lid with a pull-open closing element, defined by a line of incision with an open profile, to obtain a "stay-on-tab" configuration, which provides an opening lever connected to the closing element by means of an integral rivet, which is disposed inside the perimeter defined by the line of incision.

U.S. Pat. No. 3,773,210 is also known, which describes a lid with a pull-open closing element, defined by a line of incision with a closed profile, to obtain a completely removable closing element. In this case too, a rivet is provided to connect the opening lever to the closing element, disposed inside the closed profile line of incision.

If the substances contained in the containers in question are to be eaten/drunk by humans or animals, there is a strongly felt need to guarantee that the closing element does not enter inside the container, not even minimally, thus preventing contamination of the substance inside: in other words, it is necessary to produce lids and containers that are hygienic. This is to prevent extraneous contaminating or polluting substances from being ingested, such as dust, dirt, germs, bacteria or other pathogens.

This need is even more strongly felt in places where the containers are kept, even only temporarily, in the open or in unprotected places where the strangest substances can be deposited on the lid. In this case, if for example the container contains a drink or a medicine, and if the closing element carries said substances inside the container, even dangerous conditions may be created for the user.

This need is also strongly felt as indicated when pharmaceutical substances are ingested, where the pathological condition of the person or animal ingesting the substances may not support the presence of the contaminants, pollutants or pathogens.

Systems known in the state of the art can suffer the disadvantage that even a minimum part of the closing element may go toward or face, even temporarily, inside the container when it is opened, thus creating hygiene and health problems.

Additionally, with known systems there is a limit to the use of containers with such lids, since there is no guarantee of hygiene and/or non-contamination. This limit prevents the use of such containers for transport and/or storage of contaminating material, or material that must not be contaminated.

Furthermore, with known systems there are limits to the type of content, and they are therefore unsuitable, in certain cases, for the passage of a sufficient quantity of air in a limited time, creating turbulence for the liquid coming out.

There is therefore a need to perfect a lid for containers of substances and a container of substances comprising said lid, which can overcome at least one of the disadvantages of the state of the art.

In particular, the purpose of the present invention, which by way of example can be widely applied in lids of hygienic containers for drinks, is to overcoming the shortcomings of known solutions, and in particular to improve and perfect the inventive ideas expressed in WO-A-2009/030526 and WO-A-2011/001273, obtaining new advantages not seen before.

In particular, the present invention proposes to obtain a closing system which, during opening, substantially guarantees the hygiene and non-contamination of the substance contained in the container, preventing even a minimum part of the closing element from going inside the container during opening.

Indeed it must be remembered that due to the normal construction of the closing element and the opening system connected to it, a perfect cleanliness before opening is neither simple nor easy.

In fact it has been seen that, if the edge of the closing element protrudes even by a little from the rivet or mechanical clamping element which rigidly connects the closing element with the opening lever, either due to a possible lack of uniformity of the line of incision, or due to the presence of lines of weakening that can affect the metal sheet of the lid in various directions, or due to problems of tolerances or other reasons, on certain occasions the protruding part bends and enters under the lower plane of the lid, thus causing an unlimited risk of contamination or pollution. The contamination or pollution can also be two-directional, that is, from the outside to the inside but also from the inside to the outside.

Even if part of the closing element enters only a little, this does not guarantee absolute hygiene, nor does it prevent the risk of contamination.

This disadvantage, even if it only occurs occasionally, is one that drastically limits the use of said lid in containers that contain drinks or foods, and also pharmaceutical substances, supplements, chemical products or special products such as seeds, or laboratory products, etc.

Furthermore, it is also a purpose of the present invention to position the closing element irrespectively with respect to the peripheral edge of the lid, since the position of the closing element can depend on the material—fluid, liquid, pasty, granular, powder or other—present in the container, and also dependent on the instruments used to remove and/or work it.

It is also a purpose of the present invention, thanks to the different structure conferred on the molds and on the production cycle that can be achieved with them, to obtain a very high production regimen of the lids, with a value that can exceed by many percentage points the most evolved production regimens with the same guarantees.

It should be remembered that in characterizing a standard lid as desired, one requirement is not only to obtain depressions and ridges, and the lines of incision, pre-cutting or breakage able to define the closing element, but also to position the lever and attach it to the lid in a precise and defined manner.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a lid according to the present description, which overcomes the shortcomings of the state of the art and eliminates the defects therein, can be used as a hygienic and/or anti-contamination lid for a container, for example typically made of metal, able to contain a substance, for example fluid, liquid or solid, powder, granular or other solid form.

According to some forms of embodiment described here, the lid comprises:

a closing element defined by a line of incision and provided with a front portion, an opening lever disposed astride the line of incision and comprising a fulcrum front end disposed at the front of the front portion, and an intermediate region provided with a flexible tongue attached to the closing element, a mechanical element configured to attach the flexible tongue mechanically to the closing element, and provided with an upper abutment head, which is configured to cooperate with the flexible tongue and is delimited peripherally by an external periphery.

According to the present invention, the mechanical element is disposed essentially tangent to the front portion of the line of incision, providing that the external periphery of the upper abutment head is aligned orthogonally to the line of incision.

According to the present invention, the closing element is totally lifted by the lever, therefore without entering in any way into the container, as happens in the state of the art, but can always remain attached to the lid.

According to some forms of embodiment of the invention, the line of incision that defines the closing element when the user acts on the lever has a cross section with a variable profile, that is, it does not have a cross section with a constant profile but is such that, on the one hand, it facilitates the start of pulling, and on the other it improves the final opening, since it provides both that the closing element remains anchored to the lid ("stay-on tab"), and also that the closing element is completely separated and removed from the lid.

Moreover, the invention may also be embodied providing that the line of incision is sized to define a small closing element, for example for normal drinks or in general those that do not produce much froth, or a bigger closing element, for example for drinks that produce a lot of froth, such as beer in general, or granulated drinks or other.

According to some forms of embodiment of the invention, specific means and devices are also provided that, during construction, guarantee a correct connection of the mechanical element, in particular obtained with the material of the lid, and the opening lever, thus preventing waste even when there is a high production.

According to some forms of embodiment of the invention, means may also be provided to guarantee a perfect positioning of the opening lever during the automatic positioning and integration step, thus improving the productivity, quality and usability of the lid.

A possible feature of the invention is to provide, in some forms of embodiment, a precise conformation of the line of incision, in order to be certain that the closing element, during opening or open, does not detach easily from the lid, and consequently does not cause pollution.

According to some forms of embodiment of the invention, a depression may also be provided that contains or encloses the closing element, with a defined conformation and for example a decreasing depth. This conformation allows to improve the action of the opening lever, at the same time preventing the formation of swelling, or unwanted deformation of the lid, under the thrust of possible gases in the substance present in the container, for example carbon dioxide, or inert gases such as nitrogen.

The present invention also concerns a container for any substance whatsoever comprising a lid according to forms of embodiment described here.

These and other aspects, characteristics and advantages of the present disclosure will be better understood with reference to the following description, drawings and attached claims. The drawings, which are integrated and form part of the present description, show some forms of embodiment of the present invention, and together with the description, are intended to describe the principles of the disclosure.

The various aspects and characteristics described in the present description can be applied individually where possible. These individual aspects, for example aspects and characteristics described in the attached dependent claims, can be the object of divisional applications.

It is understood that any aspect or characteristic that is discovered, during the patenting process, to be already known, shall not be claimed and shall be the object of a disclaimer.

BRIEF DESCRIPTION OF THE DRAWINGS

These and other characteristics of the present invention will become apparent from the following description of some forms of embodiment, given as a non-restrictive example with reference to the attached drawings wherein:

FIG. 20 is a longitudinal section of the lid in FIG. 18, from A to A;

FIGS. 21*a*-21*c* show forms of embodiment of possible conformations of the profile of the cross section of the line of incision in various segments along which the line of incision develops;

Figure 1:
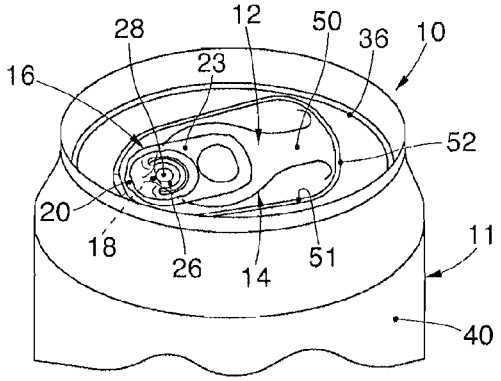
FIG. 1 is a perspective view of a lid according to forms of embodiment described here, for example provided on a container.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF A FORM OF EMBODIMENT

We shall now refer in detail to the various forms of embodiment of the present invention, of which one or more examples are shown in the attached drawings. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

FIGS. 1, 2, 3 and 4 are used to describe forms of embodiment of a lid 10 according to the present description, usable as a lid for a container 11 able to contain a substance, for example fluid, liquid, powder, granular or other solid form, in particular a pourable substance, for example substances that can be eaten/drunk by humans or animals, such as drinks, food substances in general, food supplements, pharmaceutical substances, etc.

For example, the liquid substance can be a drink, such as a carbonated drink, a soft drink, an alcoholic drink, fruit juice, tea, infusion, beer, energy drink or other.

The container 11 can for example be configured as the container of a can.

Generally speaking, both the lid 10 and the container 11 can be made of metal, such as aluminum or alloys thereof, or an iron-based metal, in particular steel-based, considering that the materials of the lid 10 and container 11 can be different from each other, but coherent and compatible with the substance contained. For example for carbonated drinks, that is, to which gas has been added or which contain gas through fermentation, the lid 10 can be made of aluminum or iron or alloys thereof, as usually happens.

It may also be provided that the internal part of the container 11 and of the lid 10 is coated with a suitable coating, for example a protective film coherent and compatible with the requirements of the content. A protection may also be provided, with materials such as plastic, ceramic or other similar materials, depending on the content and/or the time it is contained. Advantageously, but not necessarily, the coating is stably integrated with the internal surface of the container 11.

The plan sizes of the container 11 can be similar to that of the lid 10, or they can be bigger or smaller. In this way for example, the container 11 can have the same diameter as the lid 10, or it can have a bigger or smaller diameter.

Some forms of embodiment, described hereafter, provide that the lid 10 is the easy-open type.

According to the present description, the lid 10 comprises a closing element 12 defined by a line of incision or pre-cutting 14. The closing element 12 is a part of the surface of the lid 10.

The line of incision 14 can delimit peripherally a delivery aperture 15, which is normally closed by the closing element 12 and through which it is possible to deliver or pour the substance contained in the container 11.

According to possible forms of embodiment, the closing element 12 delimited by the line of incision 14, and hence also the delivery aperture 15 defined thereby, has a maximum width W, which for example can be comprised between about 24.0 mm and about 24.5 mm, in particular between 24.1 mm and 24.4 mm.

The closing element 12 can be lifted or detached from the lid 10, generating the delivery aperture 15.

Possible forms of embodiment described here can provide that the lid 10 is the type with stay-on-tab. To this purpose, according to possible forms of embodiment described here, the line of incision 14 can be interrupted, that is, it can have an open profile, for example at least partly curved in shape, or in any case with a mixed curvilinear/linear development. The fact that the line of incision 14 can be interrupted, that is, can have an open profile, means that the closing element 12, once lifted from the lid 10, can in any case remain connected to it (stay-on-tab), without any risk of becoming dispersed in the environment, and thus preventing pollution.

Figure 18:
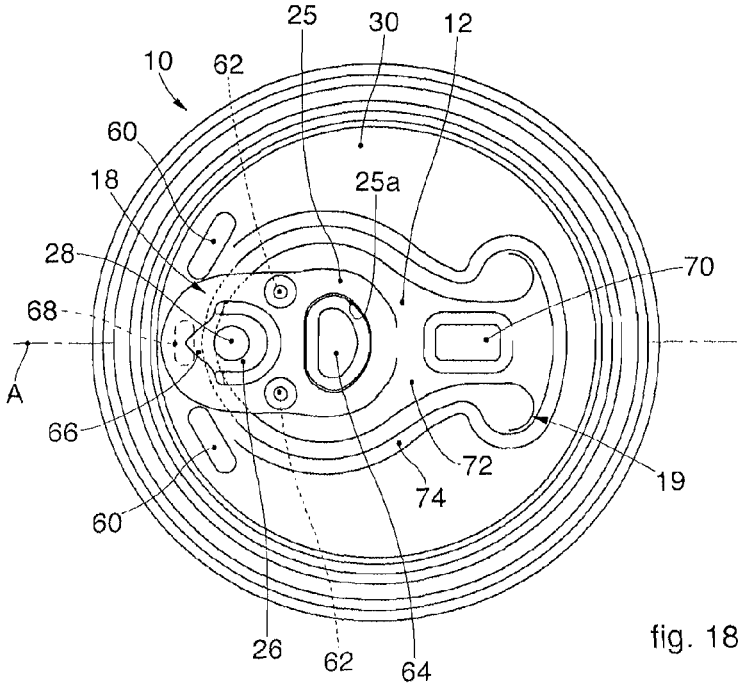
FIG. 18 shows an advanced variant of a lid according to forms of embodiment described here, which allows to improve the production rhythm and at the same time to improve use.

FIG. 18 is used to describe forms of embodiment of the lid 10 in which it expressly provides that, due to how the development of the line of incision 14 is made, the closing element 12 when lifted is difficult to detach from the rest of the lid 10, for example breaking, due to the presence of terminal branches 19, or burrs, that is, segments of the line of incision 14 curved toward the outside (see for example FIGS. 2, 3, 18) which perform an elastic function of absorbing the stress, preventing the closing element 12 from breaking.

Figure 14:
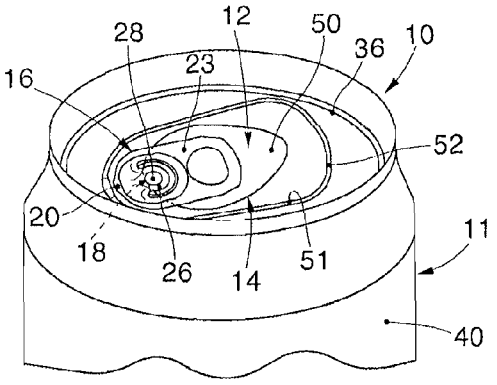

In other forms of embodiment, which can be combined with all the forms of embodiment described here, the line of incision 14 may not have the interruptions, that is, it can have a closed profile (see for example FIG. 14). In this way, once lifted and pulled, the closing element 12 can be separated and removed completely from the lid 10 and then eliminated. This possible form of embodiment can be useful if intervention is required on the substance contained in the container 11, for example using sampling or analysis instruments, which can pass through the delivery aperture 15 without having the bulk of the closing element 12 on the lid 10.

The line of incision 14 is a pre-cut line that defines a predetermined breaking profile, along which the closing element 12 can be pulled and detached. The line of incision 14 can be made according to known techniques in the state of the art.

Figure 4:
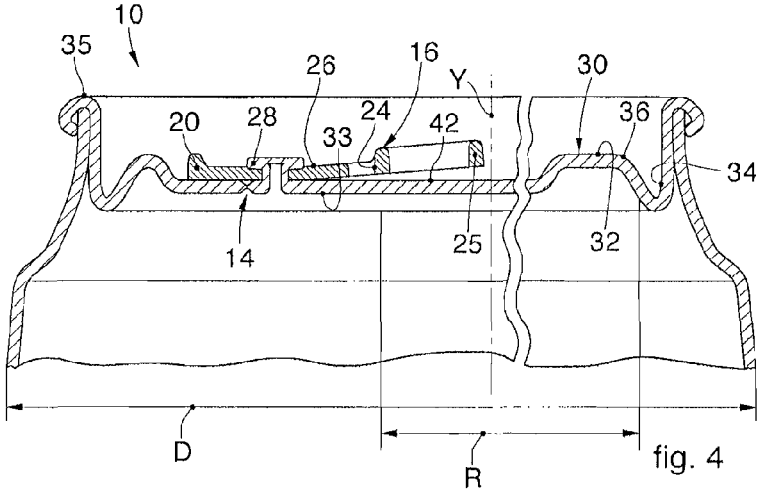
FIG. 4 is a lateral section of a lid according to forms of embodiment described here.
Figure 4A:
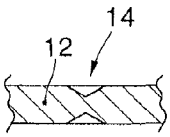
FIG. 4*a* is an enlarged detail of FIG. 4.
Figure 4B:
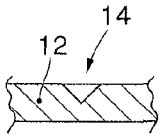
FIG. 4*b* is an enlarged detail of a variant of FIG. 4.

FIG. 4*a* is used to describe forms of embodiment in which the line of incision 14 is made by means of two opposite and converging incisions, for example V-shaped, while FIG. 4*b* is used to describe forms of embodiment in which the line of incision 14 is obtained by a single converging incision, in this case too, for example, V-shaped. FIGS. 21*a*, 21*b*, 21*c* provide other possible forms of embodiment of the line of incision 14.

In particular, the line of incision 14 can be provided with a front portion 18, in this case for example curvilinear, or in any case formed by curvilinear segments.

In possible forms of embodiment, the curvilinear open profile of the line of incision 14 is provided, on a side opposite the front portion 18, with two terminal branches 19 (see for example FIGS. 1, 2, 7-11, 18, 19), whose purpose is to prevent the closing element 12, during opening or when open, from detaching from the rest of the lid 10, for example breaking.

Figure 13:
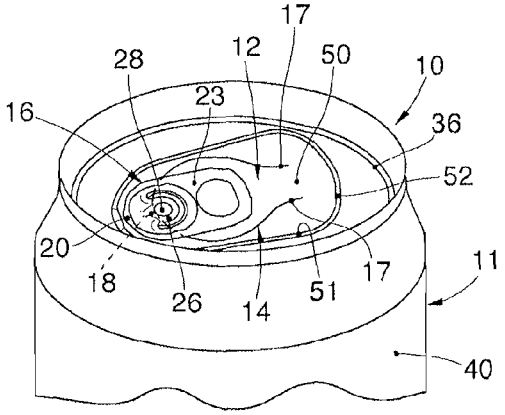
FIGS. 13-17 are perspective views of other possible forms of embodiment of a lid, for example provided on a container, according to the present description.

In other possible forms of embodiment, which can be combined with all the forms of embodiment described here, the curvilinear open profile of the line of incision 14 can end in straight segments 17, that is, without terminal branches 19 (see for example FIG. 13), for example when it is desired to make it possible for the user to decide whether to keep the closing element 12 connected to the lid 10 or to detach it easily and completely (FIG. 14).

According to forms of embodiment described using FIGS. 18, 19, 20, 21*a*, 21*b*, 21*c*, the line of incision 14 can provide a cross section with a variable profile along the development of the line of incision 14, in particular, according to a variant, the line of incision 14 can provide at least two, or in this case three, levels of incision (see for example FIGS. 21*a*, 21*b*, 21*c*).

With regard to the incision, we shall now describe for example a lid 10 made of aluminum with a thickness of around 0.25 mm.

Figure 19:
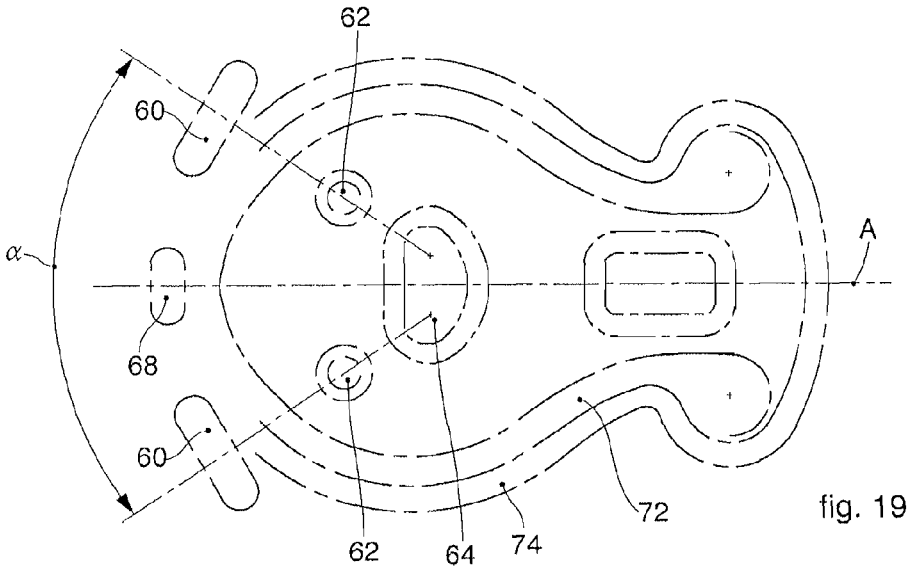
FIG. 19 shows schematically both the line of incision and also the lines of depression-ridge of a lid according to forms of embodiment described here.

A first level of incision is made for a segment of the line of incision 14 which is contained inside an angular sector α comprised between about 40 and 80 degrees, advantageously between around 50 and 70 degrees (see FIG. 19).

In particular, the first level of incision, shown in FIG. 21*a*, provides an incision 14*a* with an angle β, or angle of opening of the incision, comprised between 40 and 60 degrees, advantageously around 50 degrees.

Advantageously, the choice and design of the amplitude of the angle β, or angle of opening of the incisions 14*a*, 14*b*, 14*c*, described using FIGS. 21*a*, 21*b*, 21*c*, can be made according to the type of substance present in the container and whether the substance contains gas, or if the container is under pressure internally, also to be able to prevent problems or disadvantages connected to venting/bursting phenomena which for example could occur in the first stages of opening, when the gas is emitted.

The incision 14*a* provides a base 55 with a width correlated to a depth 55*a* of the incision 14*a* in the material, and hence to a thickness 56 of the material of the lid 10.

Advantageously, the choice and design of the width of the base 55 of the incisions 14*a*, 14*b*, 14*c* described using FIGS. 21*a*, 21*b*, 21*c* can also be provided depending on the substance in the container, and whether the substance is carbonated, in this case too to prevent problems or disadvantages during opening, connected to venting/bursting phenomena.

According to possible forms of embodiment, the difference between thickness 56 and depth 55*a* defines a remaining thickness 56*a* which, for example in the case of the angular sector α in FIG. 21*a*, is around 0.114 mm and can vary from 0.110 mm to 0.120 mm (see FIG. 21*a*).

FIGS. 21*b* and 21*c* show a second and third level of incision respectively, defined by corresponding incisions 14*b* and 14*c*, which have different depths 55*a*, and possibly different thicknesses 56.

In the case of the zone of the line of incision 14 that defines the terminal branches 19 of the line of incision or pre-cutting 14, the line of incision 14 provides said third level of incision defined by the incision 14*c* (see FIG. 21*c*) which defines a remaining thickness 56*a* comprised between 0.150 mm and 0.160 mm, advantageously around 0.155 mm.

In the remaining part of the line of incision or pre-cutting 14 (FIG. 21*b*), that is, not included in the angular sector α and which does not define the terminal branches 19, the second level of incision is provided, defined by the incision 14*b* which defines a remaining thickness 56*a* comprised between 0.160 mm and 0.170 mm, advantageously around 0.165 mm.

In this way, the initial breakage is facilitated, in particular in the angular sector α where the incision 14*a* is provided, and the possibility of the closing element 12 detaching from the lid 10 is impeded and prevented, particularly in the zone of the terminal branches 19 where there is the incision 14*c*.

It is obvious that the different depth 55*a* and character in terms of width and/or amplitude of the angle of aperture of the incision 14*a*, 14*b*, 14*c* can also vary in extension. For example, in the case of forms of embodiment described using FIG. 14, the incision 14*c* described using FIG. 14*c* may be absent. According to possible forms of embodiment, the lid 10 also comprises an opening lever 16, to open the closing element 12.

The opening lever 16 is disposed astride the line of incision 14, partly above the closing element 12 and partly outside it. According to the present description, the opening lever 16 can have at one end a fulcrum part on the lid 10, and at an opposite end it can be lifted. In an intermediate position the opening lever 16 is attached to the closing element 12.

The opening lever 16 can be disposed aligned along a median axis A of the lid 10 (FIGS. 2, 3, 7, 8 and 18), for example in order to improve the opening effect.

According to possible implementations, the opening lever 16 comprises a fulcrum front end 20 disposed at the front of the front portion 18, and an intermediate region 23 provided with a flexible tongue 26 attached to the closing element 12. The flexible tongue 26 is configured to bend around a bending edge 37 (best visible in FIGS. 8 and 11), integrated with the intermediate region 23 (see for example FIGS. 6, 9, 10, 11 and 12).

For example, in the intermediate region 23 an aperture 24 can be provided, with a semi-circular extension defining the flexible tongue 26, which protrudes toward the inside of the aperture 24.

The opening lever 16 can also comprise a rear drive end 22, opposite the fulcrum front end 20. In possible implementations, the rear drive end 22 can comprise a gripping ring 25 that can easily be gripped by the user to lift and rotate the opening lever 16, pivoting on the fulcrum front end 20. The gripping ring 25 can delimit a hole 25*a* (see FIGS. 3, 8 18, and 22).

The fulcrum front end 20 is disposed outside the line of incision 14. In this way, when it is rotated around the fulcrum front end 20, the opening lever 16 can press against a point outside the line of incision 14. Advantageously, the fulcrum front end 20 can be configured to define essentially a single pivoting point of the opening lever 16.

According to some forms of embodiment described here, the opening lever 16 can be second degree, that is, always advantageous, since the point of application of the resistant force (connection to the closing element 12) is intermediate between the fulcrum (fulcrum front end 20) and the point of application of the lifting force (rear drive end 22).

According to the present description, a mechanical clamping element 28 can be provided, configured to attach or connect mechanically the flexible tongue 26 to the closing element 12. In particular, the clamping element 28 is provided inside the line of incision 14. The mechanical clamping element 28 is advantageously obtained, in forms of embodiment described using FIGS. 4, 5, 6, 19 and 20, with the same material as the lid 10. The mechanical clamping element 28 is provided with an upper abutment head or bonnet 29, which is configured to cooperate with the opening lever 16, in particular with the corresponding flexible tongue 26 (FIG. 6), making the lid 10 integral with the opening lever 16. In particular, the upper abutment head or bonnet 29 is delimited peripherally by an external periphery, or external edge 57, which for example can be curvilinear, in particular circular, elliptical, oval, depending on the technology used to make it.

According to the present description, the mechanical element 28 can be disposed essentially tangent to the front portion 18 of the line of incision 14. By substantially or essentially tangent, here we mean that the external periphery, or external edge 57 of the upper abutment head or bonnet 29 of the mechanical clamping element 28 is orthogonally aligned with the line of incision 14, in particular it is aligned orthogonally with the inside of the cross section of the line of incision 14. That is to say, the orthogonal projection of the external periphery, or external edge 57 of the upper abutment head or bonnet 29 is located or falls inside the cross section of the line of incision 14 (FIGS. 2, 6 and 20), in its most advanced extension toward the fulcrum front end 20 of the opening lever 16.

In this way, in certain conditions, the center of the mechanical element 28 is at the minimum possible distance from the fulcrum front end 20 of the opening lever 16.

The mechanical element 28 can therefore be provided inside the bulk of the closing element 12 and the flexible tongue 26.

With this disposition of the mechanical element 28, essentially tangent to the front portion 18 of the line of incision 14, it is possible to open the closing element 12 without even a minimum part of it entering, even temporarily, inside the container 11, and without coming into contact with the substance contained therein and thus contaminating it, in this way obtaining a completely hygienic closing element, that is, anti-contamination. This is extremely important in the case of substances that are to be eaten/drunk by people or animals, or in the case of substances that, in general, absolutely must not be contaminated due to the unwanted entry of the closing element under the lower plane of the lid 10.

This disposition can also be advantageous to facilitate the lifting and pulling of the closing element 12, since it allows to distribute uniformly the pulling force on the material, so that the result of the pulling is repeatable, precise and reliable for all the lids that are produced.

In advantageous forms of embodiment, the pulling operation is also facilitated by the difference in the profile of the cross section of the line of incision 14, in particular considering that the incision 14*a* of the line of incision 14 in the angular sector $\alpha$ (FIG. 21*a*) has a difference with respect to the levels of incision of the remaining part of the line of incision 14 (FIGS. 21*b* and 21*c*).

Here we must point out that normally the material that constitutes the lid 10, that is, typically a metal sheet that is progressively thinned by means of several rolling passes, can have intrinsic lines of weakening, cracks or breakage, mainly due to the working to which it is subjected.

In particular, in a cast material, there may be discontinuities, such as porosity, air bubbles, and also macro-inclusions, such as the presence of aggregates of material, uneven, hard and not rollable, which can be stretched by the various rolling operations until the formation is generated of points where said lines of weakening, cracks or breakage are triggered.

The presence and position of the lines of weakening, cracks or breakage cannot be foreseen, and therefore uncertainties can arise regarding the behavior of the material subjected to stresses, like those expected during the pulling of the closing element 12, which uncertainties can translate into failed or imprecise pulls and openings. This unwanted and unforeseeable behavior can be detrimental from the point of view of marketing the product, and also potentially dangerous for the final user.

The position of the mechanical element 28, essentially tangent to the front portion 18 of the line of incision 14, solves this problem and makes the pulling action uniform, reliable and precise, irrespective of the possible presence of the lines of weakening, cracks or breakage.

The mechanical element 28 is configured as a mechanical constraint, passing through the flexible tongue 26 and constraining the latter to the closing element 12, as can be seen for example in FIGS. 2, 3, 4, 6 and 20.

According to possible implementations, the mechanical element 28 as indicated can be integral, that is, in a single body, with the lid 10, or with the closing element 12.

For example, the mechanical element 28 can be obtained in a known manner by deformation of the material of the closing element 12, so as to force the material to pass through a hole 27 made in the flexible tongue 26 (see for example FIG. 5) and subsequently providing a heading or riveting operation which, compressing the material, creates the upper abutment head or bonnet 29 and integrates the closing element 12 with the flexible tongue 26 (see for example FIG. 6).

According to possible forms of embodiment, in cooperation with the mechanical element 28 that makes the flexible tongue 26 integral with the closing element 12, the thickness of both can be reduced. For example, a portion with a reduced section can be provided, or narrow section 12*a* of the closing element 12, made following the formation of the mechanical element 28 (see FIG. 6 and the enlarged detail in FIG. 20).

According to other possible implementations, the mechanical element 28 can be a solid rivet, that is, a nail with a flat, truncated cone or semi-spherical head, used for joining metal elements, but it goes without saying that these variants entail different production cycle times.

In other possible implementations, the mechanical element 28 can be a hollow rivet, that is, a joining element similar to a solid rivet, but holed in the middle and shaped like an eyelet, generally formed by a double-headed nail. Typically, the process to make the lid 10 can provide to mold a simple lid from a roll of aluminum or alloys thereof, generally magnesium aluminum alloys, such as for example typically 5182-H48, or iron-based or iron alloy, in particular steel, for example mild or stainless steel, for example tin plated or in any case coated, or not.

The molded lids 10, which can have their internal surface flat or substantially flat, are fed in a production line that converts them into the easy-open lids 10 in question. In the production line (see for example FIGS. 4, 5, 6, 19, 20) a rivet with an integral head is formed (which functions as a mechanical element 28) in the lid 10, after incision of the line of incision 14, the mechanical clamping element 28 being advantageously obtained with the opening lever 16, itself ready, already disposed in the correct position on the lid 10.

Consequently, the opening lever 16 is directly involved in the head 29*a* (FIG. 5), which is then flattened to form the integral rivet, which functions as the mechanical element 28, which connects the opening lever 16 to the lid 10. In this way, the flattened material forms the upper abutment head or bonnet 29 with corresponding external periphery 57, which is essentially tangent to the line of incision 14 as defined above. Typically, the flattening operation acts with a symmetrical and uniform deformation of the material, which determines an axial-symmetric curvilinear shape, for example circular, of the upper abutment head 29, for example like a disc, plate or similar curvilinear flat element.

In this way, we save time and obtain better quality and repeatability, but to be certain that there will be no waste it is necessary to guarantee that the opening lever 16 remains perfectly positioned until it is made integral with the lid 10.

Figure 5:
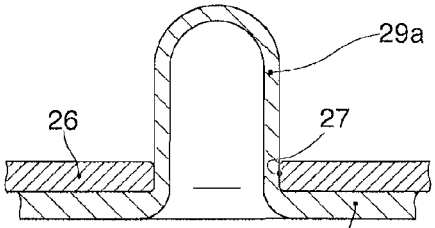
FIG. 5 is a section of part of a lid according to forms of embodiment described here, during one production step.
Figure 6:
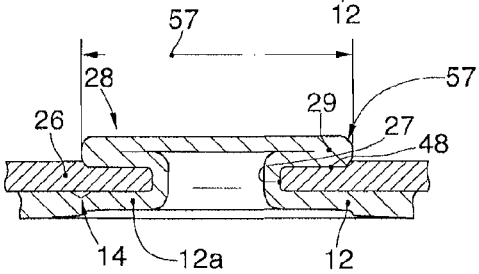
FIG. 6 is a section of part of a lid according to forms of embodiment described here, during another production step.
Figure 2:
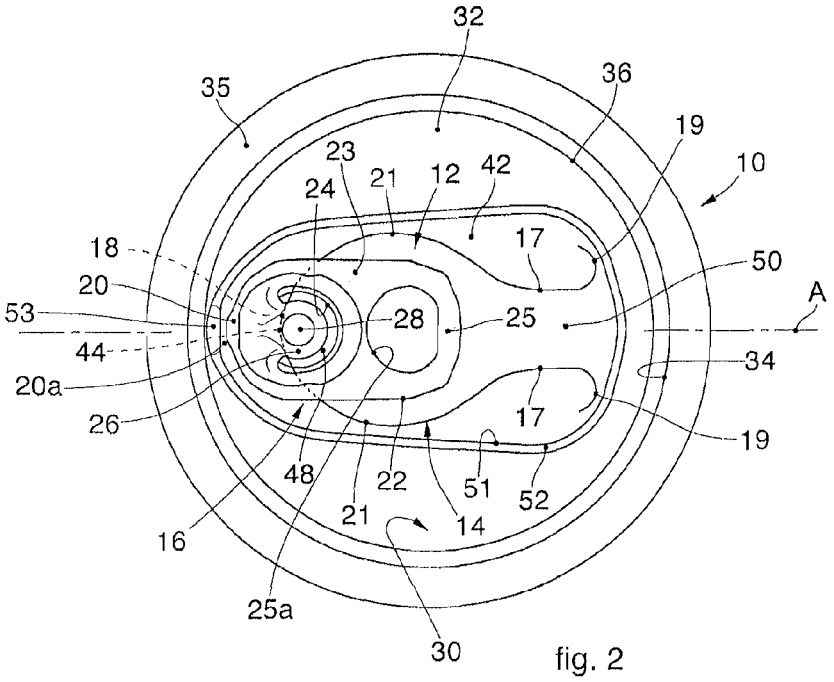
FIG. 2 is a plan view from above of a lid according to forms of embodiment described here.

According to preferential forms of embodiment described using for example FIGS. 2, 5 and 6, and which can be combined with all the forms of embodiment described here, the flexible tongue 26 is positioned for example aligned with a longitudinal axis of the opening lever 16, in particular it can also be symmetrical with it. The flexible tongue 26 can for example be protruding toward the rear drive end 22, so that the constraint with the closing element 12 is on the side of the fulcrum front end 20.

In possible forms of embodiment, which can be combined with all the forms of embodiment described here, the flexible tongue 26 can have a perimeter defined by an arc of a circle (see FIGS. 2 and 18).

In possible forms of embodiment, in the fulcrum zone of the opening lever 16, opposite the flexible tongue 26, the fulcrum front end 20 can have a perimeter defined by an arc of a circle, which can be provided with an extension or protrusion 20*a* that can constitute the front fulcrum element (FIG. 2).

For example, the arc of a circle that defines the perimeter of the flexible tongue 26 can be part of a theoretical circle that intersects the line of incision 14, in particular the front portion 18 thereof.

In possible implementations, both the aperture 24 and the flexible tongue 26 can have a perimeter defined by an arc of a circle.

For example, if the aperture 24 is also defined peripherally by an arc of a circle, the aperture 24 can be a curvilinear eyelet when the lid 10 is in the closed configuration (see FIG. 2). The curvilinear eyelet defined by the aperture 24, defining the flexible tongue 26, and the mechanical element 28 contained inside it, allow to effectively concentrate the lifting force on the resistant point defined by the mechanical element 28, and all in all to facilitate the pulling of the closing element 12.

In possible implementations, the mechanical element 28 can be disposed essentially at the center of the theoretical circle defined by the peripheral arc of the circle of the flexible tongue 26, with the provision in any case that it is tangent to the front portion 18 of the line of incision 14, as indicated above.

In this advantageous solution, the curvilinear eyelet defined by the aperture 24 can therefore symmetrically surround the mechanical element 28, increasing even more the reliability and precision of the detachment of the closing element 12.

Figure 3:
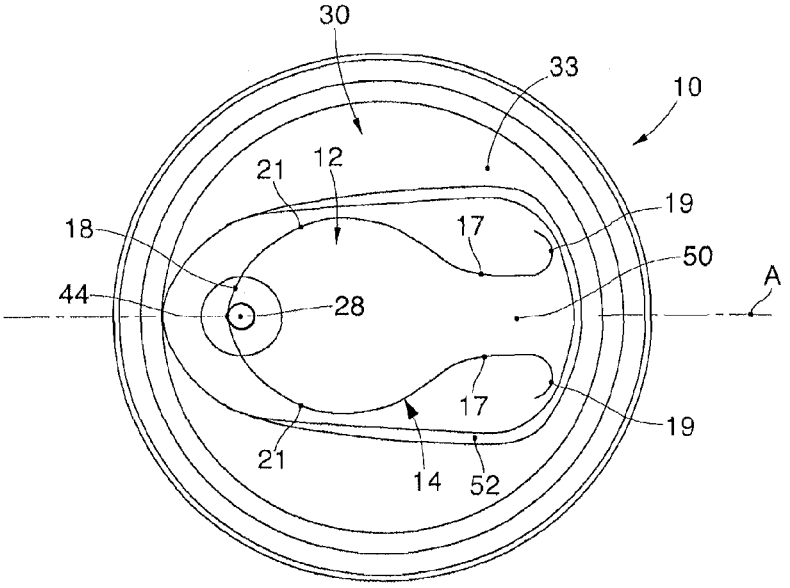
FIG. 3 is a plan view from below of a lid according to forms of embodiment described here.
Figure 7:
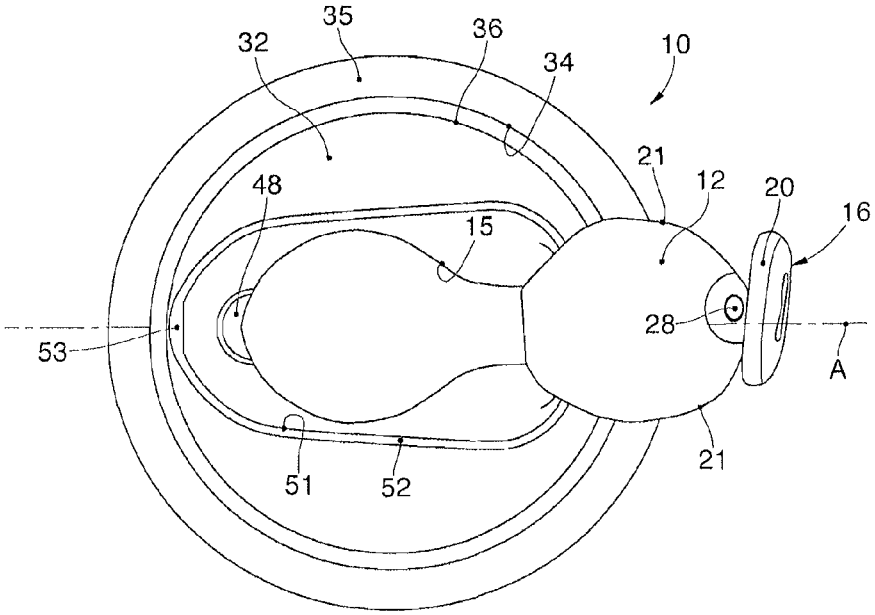
FIG. 7 is a plan view from above of a lid according to forms of embodiment described here, in an open configuration.

FIGS. 2, 3 and 4 are used to describe forms of embodiment of a lid 10 according to the present description, which can be combined with all the forms of embodiment described here, which comprises a closing wall 30 (see for example FIGS. 2, 3, 18 and 22). In possible implementations, the line of incision 14 is made on the closing wall 30. The closing wall 30 is typically circular and can have a determinate radius R (see for example FIGS. 4 and 22), which can have for example a length comprised between 22 and 24 mm, in particular between 22.5 and 23.5 mm.

According to possible forms of embodiment, the closing wall 30 can be provided with a first surface, or upper surface 32 and an opposite second surface or lower surface 33. Typically, when the container 11 is equipped with the lid 10, the first surface 32 faces toward the outside of the container 11, while the second surface 33 faces toward the inside. According to some forms of embodiment described here, the opening lever 16 is disposed above the first surface 32.

According to some forms of embodiment described here, the lid 10 can be provided with a peripheral annular groove 34, which can surround the closing wall 30. The peripheral annular groove 34 can define internally an annular peripheral bead 36. The annular peripheral bead 36 can define an annular peripheral limit of the closing wall 30. The radius R of the closing wall 30 therefore extends from the center of the closing wall 30 as far as the peripheral annular groove 34 (FIG. 4).

In possible implementations, the annular peripheral bead 36 can be provided with at least a vertical or sub-vertical edge, so as to generate a strong resistance to yielding, even only elastic.

Figure 8:
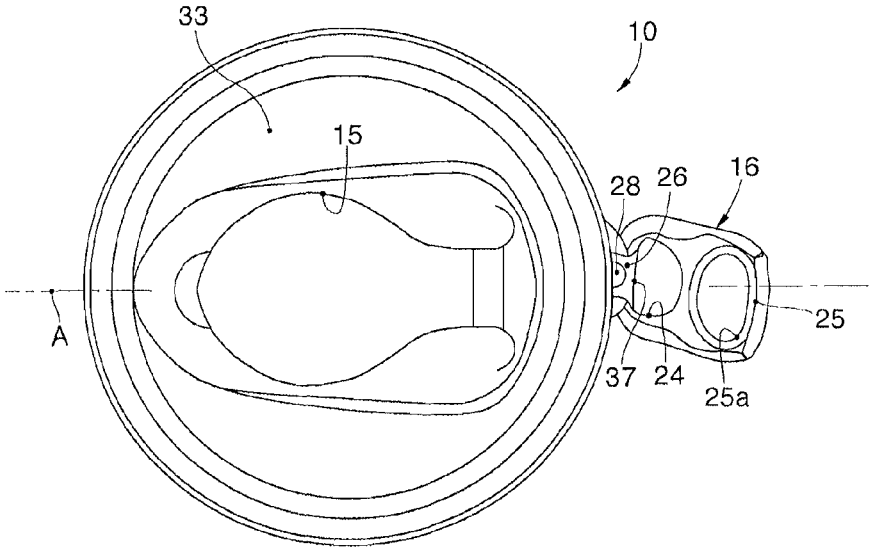
FIG. 8 is a plan view from below of a lid according to forms of embodiment described here, in an open configuration.

Outside the peripheral annular groove 34 a peripheral annular rib 35 can be provided. In this way, a cross section can be defined of the annular periphery of the lid 10 that is configured essentially U-shaped, with branches that for example can be symmetrical or asymmetrical in length. In FIGS. 3 and 8, for example, it is possible to see the conformation in negative of the peripheral annular groove 34, the peripheral annular rib 35 and the annular peripheral bead 36.

According to possible forms of embodiment, which can be combined with all the forms of embodiment described here, the opening lever 16 can be disposed with its fulcrum front end 20 near the annular peripheral bead 36, that is, in close vicinity to it (see for example FIGS. 2, 3 and 4). In these possible forms of embodiment, it may also be provided that the opening lever 16 is disposed with its rear drive end 22 disposed in a zone similar to the center of the lid 10.

Figure 16:
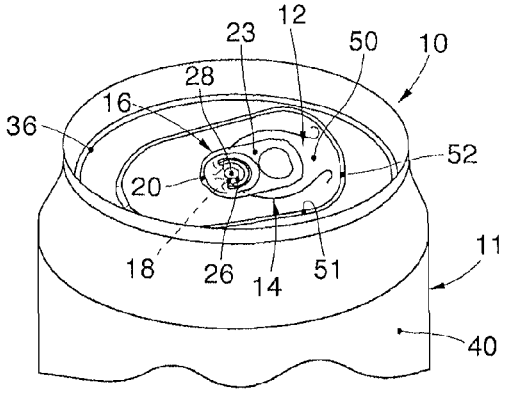

According to other possible forms of embodiment, described for example with reference to FIG. 16, which can be combined with all the forms of embodiment described here, the opening lever 16 can be disposed with its fulcrum front end 20 in a zone similar to the center of the lid 10 and therefore the opening lever 16 can be provided with its rear drive end 22 disposed nearer the annular peripheral bead 36, that is, in close proximity to it.

In still other forms of embodiment, the opening lever 16 can be disposed so that the fulcrum front end 20 and the rear drive end 22 are disposed in intermediate positions between central and peripheral.

FIGS. 1, 2, 3 and 4 are used to describe forms of embodiment, which can be combined with all the forms of embodiment described here, of a lid 10 disposed to close a container 11 which can for example have a substantially cylindrical shape, with an external lateral surface 40 and a bottom, of any known type, known in itself and not shown in the drawings; it may also be provided, as described above, that it has a bigger but also smaller diameter than that of the lid 10, or even equal to it.

According to possible forms of embodiment, which can be combined with all the forms of embodiment described here, the lid 10 can be substantially circular in shape, concentric with respect to a central axis Y of the container 11 (FIG. 4).

In some forms of embodiment, the peripheral annular rib 35 can surround a central surface 42 of the lid 10, in particular of the closing wall 30, having a determinate diameter "D", and defining the annular peripheral bead 36. The central surface 42 can be part of the first surface 32.

In possible forms of embodiment, alternative to each other, the central surface 42 can be provided completely or at least partly flat, or rounded.

According to possible forms of embodiment, the line of incision 14 can be made on the central surface 42. As we said, in some possible forms of embodiment, the line of incision 14 can have an open-profile configuration, or in other forms of embodiment, the line of incision 14 can have a closed-profile configuration.

For example, the line of incision 14 can have, in particular in correspondence with the front portion 18, an at least partly circular shape, oval or drop-shaped.

In other possible forms of embodiment, the line of incision 14 can have a locally reduced or variable cross section, which can delimit the closing element 12.

In possible forms of embodiment, which can be combined with all the forms of embodiment described here, the line of incision 14 can be provided, near the front portion 18, with a protruding concentrator segment 44, which can have for example a tapered conformation or for example pointed, cuspid or nose-shaped.

For example the front portion 18 can be formed by two symmetrical curvilinear segments 21 with respect to a median longitudinal axis of the lid 10 and converging to define the protruding concentrator segment 44.

The protruding concentrator segment 44 can be configured to concentrate the force lines of the stresses acting on the material, in particular at the start of pulling and lifting, at a point or limited group of points, so that the pulling is carried out easily and precisely.

The disposition of the mechanical element 28 substantially tangent to the front portion 18 can make the concentration of the force lines, in a desired and pre-defined zone, extremely advantageous, obtaining a reliable and repeatable pull.

In substance, the protruding concentrator segment 44 can represent the point, or limited group of points, where a fracture begins and from where it propagates, which allows to lift and detach the closing element 12. Consequently, the conformation of the protruding concentrator segment 44 can allow to concentrate the opening action exerted by the user, to facilitate the pulling of the closing element 12 and hence the opening of the corresponding delivery aperture 15.

In fact, the closing element 12, which is normally a continuous material with the lid 10, closes the corresponding delivery aperture 15, through which the substance can be made to come out of the container 11.

In particular, in a closed configuration of the container 11, the closing element 12 completely and hermetically closes the delivery aperture 15 (see for example FIGS. 1, 2, 3 and 4), whereas in an open configuration (see for example FIGS. 7, 8, 9, 10 and 11) it is at least partly lifted from the delivery aperture 15, but still remains integrated with the remaining part of the container 11.

As discussed above, the closing element 12 can be attached integral with the opening lever 16 which, in the closed condition, at least partly overlaps it.

The opening lever 16 can be driven manually to rotate (see for example FIGS. 9, 10 and 11), by means of the rear drive end 22, to lift and separate the closing element 12 from the remaining part of the lid 10, along the line of incision 14.

For example, acting on the gripping ring 25 can cause a rotation of the opening lever 16 around its fulcrum front end 20.

This can cause the intermediate region 23 of the opening lever 16 to be distanced from the central surface 42, and a corresponding partial detachment of the closing element 12, starting from a favorable breaking point of the line of incision 14, which can be for example near the protruding concentrator segment 44, so that the delivery aperture 15 begins to open. In particular, the start of the breakage is very effective, precise and localized thanks to the positioning of the mechanical element 28, essentially tangent to the line of incision 14.

Since the fulcrum front end 20 and the connection zones between the intermediate region 23 and the flexible tongue 26, and between the latter and the closing element 12 are in close proximity, and considering that the mechanical element 28 is at minimum distance from the fulcrum front end 20, the opening lever 16 can also define an extremely favorable arm which allows, with limited effort, to apply a high angular moment.

Furthermore, the pulling force of the opening lever 16 can be applied at a point of application in close proximity to the line of incision 14, essentially at a point, or limited group of points, tangent to the line of incision 14, in particular the front portion 18 of said line 14, for example near the protruding concentrator segment 44 of the line of incision 14, and with a rotation toward the outside of the container 11.

According to some forms of embodiment described using FIG. 2 for example, and which can be combined with all the forms of embodiment described here, an area 48 may be provided, near the front portion 18 of the line of incision 14, with a reduced thickness (see FIGS. 2 and 6) of the central surface 42 of the lid, which can further facilitate the pulling of the closing element 12 along the line of incision 14.

Figure 9:
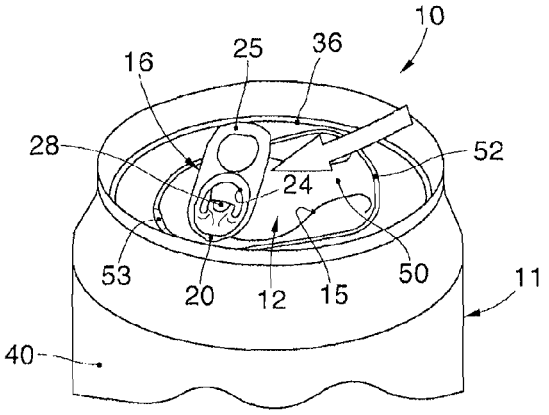
FIG. 9 is a schematic view of a lid according to forms of embodiment described here, provided on a container, in a partly closed condition.
Figure 10:
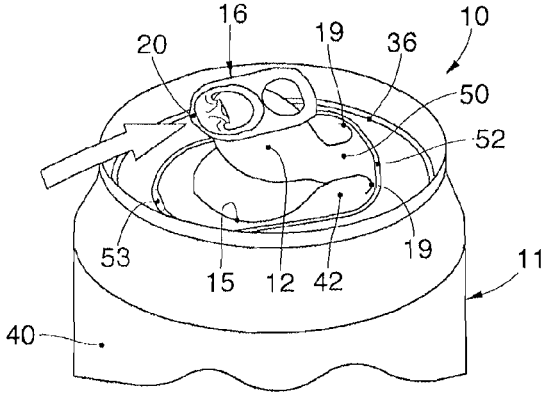
FIG. 10 is a schematic view of a lid according to forms of embodiment described here, provided on a container, in the opening step.

Therefore, it is clear from the above description that the force needed to lift the closing element 12 along the line of incision 14 is not only much less compared with containers with a hygienic closing element, that is, a closing element opening outward as in the state of the art, but is also better distributed and exploited, so that the operation gives a uniform, precise, repeatable and reliable detachment (see FIG. 9 for example).

In particular, the resistance of the mechanical element 28 causes the initial detachment of the closing element 12, which is immediately lifted by the initial pulling in precise correspondence with the line of incision 14, in particular its front portion 18, preventing even a minimum part or edge thereof from entering inside the container 11, contaminating the substance contained therein.

Another upward distancing of the opening lever 16 (see FIG. 10 for example) can allow to separate the closing element 12 from the central surface 42.

Figure 11:
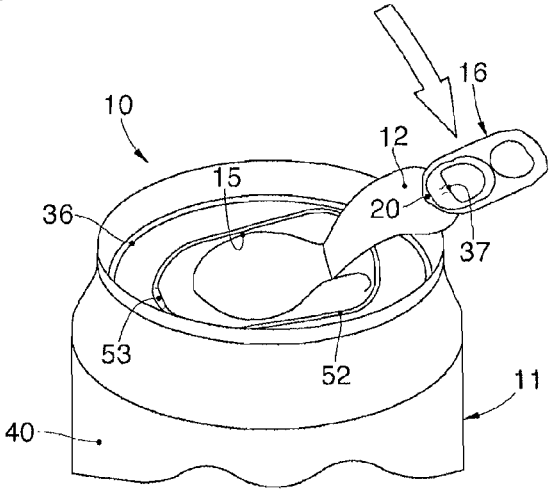
FIG. 11 is a schematic view of a lid according to forms of embodiment described here, provided on a container, in an open configuration.
Figure 12:
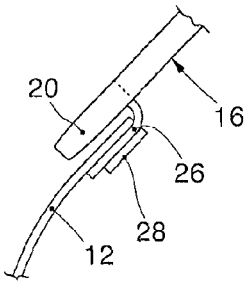
FIG. 12 is an enlarged detail of FIG. 11.

Continuing the rotation and traction on the opening lever 16, the flexible tongue 26 progressively bends on itself along the bending edge 37 (see FIGS. 8 and 11), allowing the subsequent positioning of the closing element 12 in a folded configuration, in any case integral with the lid 10 (FIGS. 11 and 12).

According to some forms of embodiment, described using FIG. 2 for example, and which can be combined with all the forms of embodiment described here, the closing element 12 can be provided at the rear with a connection edge 50, which for example can be substantially rectangular in shape, defined by a rear part of the line of incision 14, for example by two intermediate parallel segments 17 thereof. The connection edge 50 can solidly connect the closing element 12 to the remaining part of the lid 10, in particular the central surface 42, so as to prevent it from completely detaching from the latter, even in the open configuration of the lid 10 (see for example FIGS. 5 and 11).

For example, the intermediate parallel segments 17 can be connected on one side to said symmetrical curvilinear segments 21, while on the other side they can terminate with the terminal branches 19 of the line of incision 14.

In particular, the terminal branches 19, if provided, can be symmetrical with respect to each other and configured as curvilinear segments bent toward the outside of the line of incision 14, that is, starting in opposite directions with respect to a median axis of the connection edge 50 (see FIG. 2 for example). The terminal branches 19 can be provided for example in a peripheral position on the central surface 42 of the closing wall 30, for example near the annular peripheral bead 36. For example, this can be achieved by providing an elongated conformation of the connection edge 50.

Figure 15:
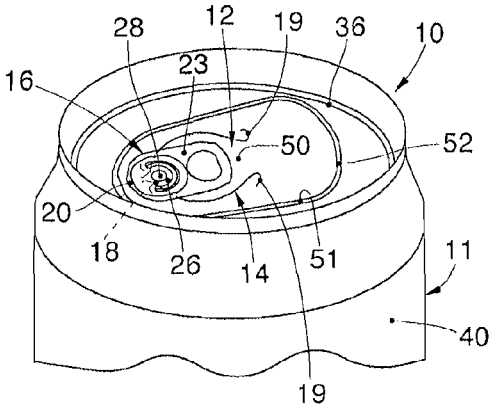

In other possible forms of embodiment, described for example with reference to FIG. 15 and which can be combined with all the forms of embodiment described here, the terminal branches 19 can be provided for example in an intermediate or central position on the central surface 42. In this case, the connection edge 50 can have a shortened conformation.

Advantageously, the terminal branches 19 provided at the rear of the connection edge 50 can function as elasticization connectors, which can allow a locally elastic behavior of the closing element 12 once opened, making it less dangerous for the user for example.

For example, the terminal branches 19 can be transverse to a median longitudinal axis of the opening lever 16, and therefore also transverse to a direction of opening in which the opening lever 16 and the closing element 12 (integrated with it) are pulled, so as to completely open the container 11. Consequently, the terminal branches 19 can also serve the function of preventing an excessive and unwanted advance of the breakage during opening, preventing the formation of dangerous cutting edges.

According to some forms of embodiment, described using FIGS. 1 and 2 for example, and which can be combined with all the forms of embodiment described here, the lid 10 can also comprise a reinforcement seating 51 which can be defined on the perimeter by a closed reinforcement edge or step 52, for example made on the central surface 42 of the closing wall 30. The reinforcement edge 52 can constitute ribs suitable to reinforce the lid 10, effectively resisting against the pulling of the closing element 12.

In particular, according to some forms of embodiment, which can be combined with all the forms of embodiment described here, the reinforcement seating 51 can be recessed or lowered with respect to a lying plane of the central surface 42. The reinforcement edge 52 of the reinforcement seating 51 can be stepped, or configured as a decreasing surface, for example as provided with reference to the depression 72 described hereafter using FIGS. 18 and 19.

To this purpose, the reinforcement edge 52 can be shaped so that the reinforcement seating 51 is lying on a plane lowered with respect to the lying plane of the central surface 42, so as to resist with greater efficacy against the upward traction which is needed to remove the closing element 12. In this way, the possible deformations of the central surface 42, during the pulling and lifting of the closing element 12, can be reduced to a minimum.

The reinforcement edge 52, and also in a coordinated manner the reinforcement seating 51, as we said can have a closed perimeter profile, which can completely surround the closing element 12 and the opening lever 16, at least in the closed configuration of the container 11 (see FIG. 2 for example).

For example, the reinforcement edge 52 can be made annularly around the line of incision 14, so that both the closing element 12 and the opening lever 16 are substantially inside the reinforcement seating 51.

The terminal branches 19, for example to obtain a suitable elasticization, can therefore be provided inside the reinforcement edge 52, that is, comprised in the reinforcement seating 51, for example in close proximity to the reinforcement edge 52 (see FIG. 2 for example).

In some forms of embodiment, described for example using FIG. 2 and which can be combined with all the forms of embodiment described here, the reinforcement edge 52 can be provided at the front with a front lowered zone 53, typically in substantial correspondence and alignment with the fulcrum front end 20 where the fulcrum of the opening lever 16 is applied. The front lowered zone 53 can therefore create a desired localized yielding of the material in the pivoting zone, which can be useful when the pulling operation is started.

Figure 17:
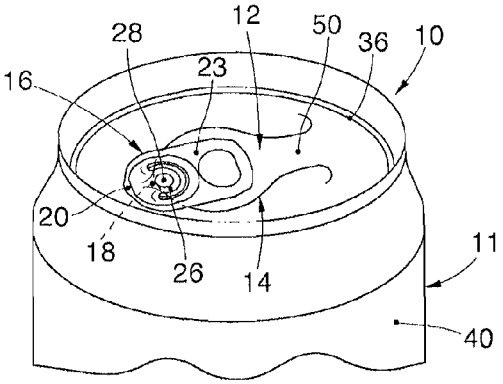

FIG. 17 provides forms of embodiment, which can be combined with all the forms of embodiment described here, in which the lid 10 may not have the reinforcement seating 51 and the corresponding reinforcement edge 52.

FIGS. 18, 19 and 20 are used to describe forms of embodiment, which can be combined with all the forms of embodiment described here, in which the lid 10 is provided with depressions and/or ridges and/or studs, which on the one hand serve to make the upper part of the lid 10 rigid so that it does not deform during use due to the pressure of possible gas inside, and on the other hand have been designed to position the opening lever 16 perfectly, in particular during the production cycle and before the mechanical element 28 is made, which makes the lid 10 and the opening lever 16 integrated with each other.

In particular, in forms of embodiment provided in FIGS. 18 and 19, which can be combined with all the forms of embodiment described here, the lid 10 is provided with lateral centering ribs 60, which cooperate with the front lateral edge of the opening lever 16 in order to center it. The lateral centering ribs 60 are advantageously aligned with respect to the median axis A of the lid 10 (FIG. 18).

The lateral centering ribs 60 in particular are disposed at the front of the opening lever 16, outside the line of incision 14, in particular at the sides of the fulcrum front end 20.

For example, two ridges 60 can be provided, disposed symmetrical on one side and the other with respect to the opening lever 16. For example, the lateral centering ridges 60 can be provided inclined with respect to the median axis A, in converging directions.

More in particular, the lateral centering ridges 60 can be disposed in converging inclined directions, whose extensions intersect inside the bulk of the lid 10, for example in substantial correspondence with the top of the opening lever 16 that defines the fulcrum front end 20.

The lateral centering ridges 60, protruding from the upper surface of the lid 10, are provided to function as lateral reference elements to correctly center the opening lever 16.

In other forms of embodiment provided in FIGS. 18 and 19, which can be combined with all the forms of embodiment described here, the lid 10 has been provided with lever positioning studs 62, which are made protruding from the closing element 12 toward the opening lever 16 above, in particular in correspondence with the respective intermediate zone 23, more particularly between the aperture 24 and the hole 25*a* of the gripping ring 25.

In possible implementations, two lever positioning studs 62 have been developed, made under the opening lever 16 and symmetrical with respect to the median axis A. The lever positioning studs 62 are provided to position the opening lever 16 correctly with respect to the plane of the lid 10.

In other forms of embodiment provided in FIGS. 18, 19 and 20, which can be combined with all the forms of embodiment described here, it has been provided to make the lid 10 with a central stud 64, made protruding from the closing element 12, which cooperates with the inside of the gripping ring 25 of the opening lever 16.

In particular, the central stud 64 is disposed along the median axis A and is centered inside the hole 25*a* of the gripping ring 25. The central stud 64 has been studied to improve and guarantee the exact axial centering of the opening lever 16.

In other forms of embodiment provided in FIGS. 18 and 19, which can be combined with all the forms of embodiment described here, it has been provided to make the lid 10 with an area of depression 66 (FIG. 18) made on the upper part of the opening lever 16, near the flexible tongue 26 and the mechanical element 28 associated with it. Depending on the configuration of the molds, the area of depression 66 can be provided as a sheet-pressing zone during the production of the mechanical element 28, see for example FIGS. 5 and 6. The area of depression 66 can provide for example a zone with an angular sector converging toward the outside, for example cuspid, in particular a V-shaped zone or similar or comparable shape, extending toward the fulcrum front end 20, cooperating with the opening lever 16. For example, the V-shaped zone can be provided to guarantee and maintain the centering of the opening lever 16 when the mechanical element 28 is made.

In other forms of embodiment provided in FIGS. 18 and 19, which can be combined with all the forms of embodiment described here, it has been provided to make the lid 10 with a central support ridge 68, made protruding from the lid 10 toward the opening lever 16, outside the line of incision 14, essentially under the fulcrum front end 20 of the opening lever 16.

The central support ridge 68, which is aligned with the median axis A, is provided to support and correctly position the opening lever 16.

In particular, the fulcrum front end 20 of the opening lever 16 has been devised to cooperate with the central support ridge 68, in order to facilitate the drive of the opening lever 16.

In other forms of embodiment provided in FIGS. 18, 19 and 20, which can be combined with all the forms of embodiment described here, it has been provided to make the lid 10 with a central reinforcement and stiffening stud 70, made protruding from the closing element 12 toward the outside, to improve the production of the closing element 12 and its positioning. The central reinforcement and stiffening stud 70, aligned with the median axis A, is advantageously provided in a position corresponding to the restriction zone of the closing element 12 and further forward than the terminal branches 19, for example in correspondence with the intermediate parallel segments 17. In this way, when the closing element 12 is open, on one side the aperture extends and on the other side the elongated shape assumed by the closing element 12 facilitates the conveyance of the air inside the container and/or helps the liquid to come out, with less turbulence. This effect is very advantageous, for example, when there is beer in the container, or similar carbonated drink that produces a lot of froth. In this case, the part of the closing element 12 between the fulcrum front end 20 and the central reinforcement and stiffening stud 70 can assume a width that goes from 1.7 to 3.0, advantageously 2.0 to 2.2 times the width of the segment with substantially parallel sides of the closing element 12. It should be noted here that the concept of substantially parallel sides is a descriptive concept that contains or includes divergent sides or sides with a preferential curve.

Furthermore, the presence of the central reinforcement and stiffening stud 70 is advantageous in the presence of the terminal branches 19 because, by stiffening the structure of the closing element 12, the terminal branches 19 maintain the elastic function of the closing element 12 even after it has been completely opened, preventing breakage and the consequent definitive detachment from the lid 10. In fact, the physical stress on the material suffered by the closing element 12 as it is gradually and completely opened is absorbed by the central reinforcement and stiffening stud 70, preventing it from discharging instead onto the material in correspondence with the terminal branches 19.

In other forms of embodiment provided in FIGS. 18 and 19, which can be combined with all the forms of embodiment described here, it has been provided to make the lid 10 with a depression 72, delimited by a reinforcement edge 74, which can have a progressively decreasing depth toward the fulcrum front end 20, in order to reinforce the surface of the lid 10 with respect to the thrusts inside the container. The depression 72, which can be recessed or raised with respect to the upper surface of the lid 10, can be configured in the same way as the reinforcement seating 51, described using FIGS. 1 and 2, representing a variant thereof with an edge with a decreasing depth.

Figure 22:
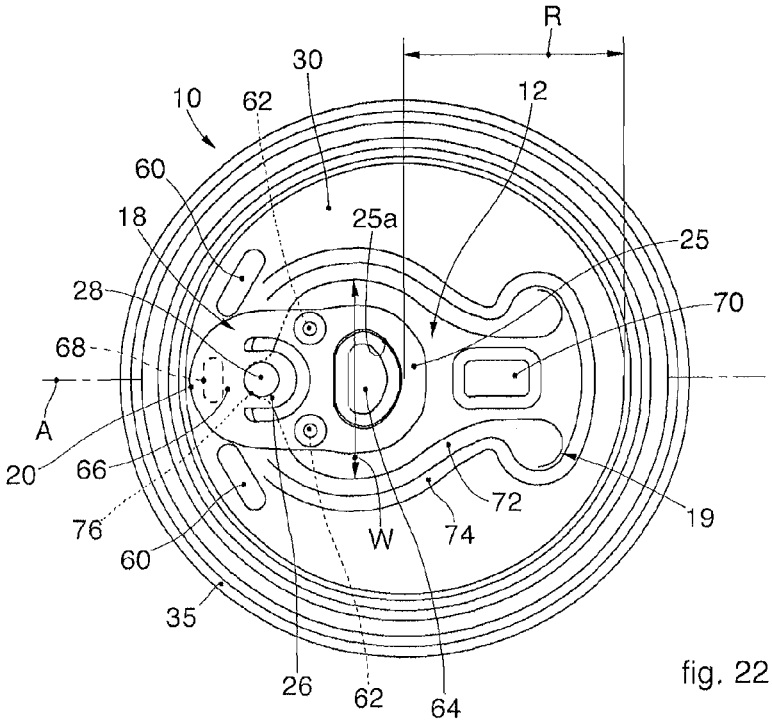
FIGS. 22 and 23 show other variant embodiments of a lid according to the present description.
Figure 23:
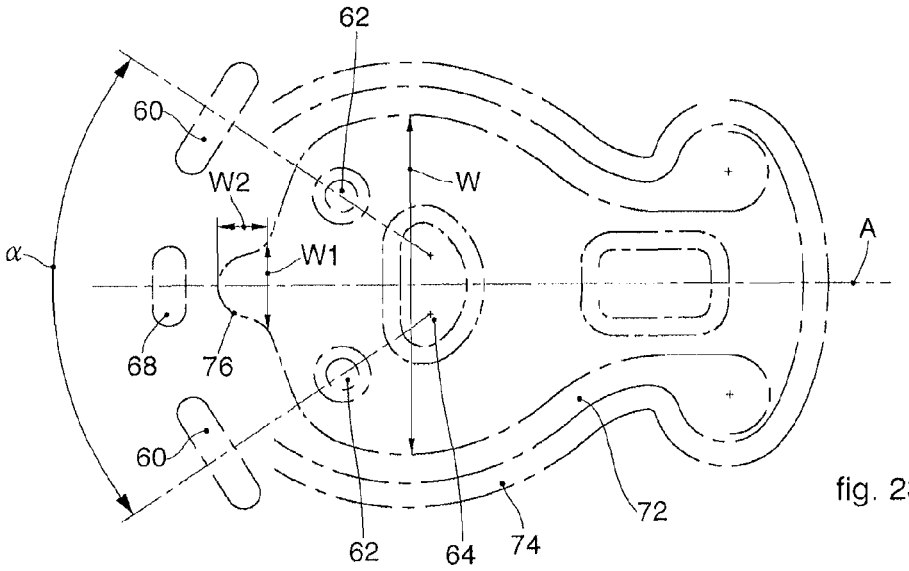

FIGS. 22 and 23 are used to describe other variant forms of embodiment, which can be combined with all the forms of embodiment described here, of a lid 10 according to the present description, in which the line of incision 14 has at the front, in the zone where lifting and pulling begins, in correspondence with the mechanical element 28, a portion 76 protruding outside, toward the fulcrum front end 20 of the opening lever 16.

In this case, the protruding portion 76 is made in an intermediate position between the fulcrum front end 20 and the gripping ring 25 of the opening lever 16 above, and is aligned longitudinally with the median axis A of the lid 10. In particular, the protruding portion 76 extends toward the outside of the closing wall 30 of the lid 10, that is, forwards, toward the peripheral annular rib 35 that surrounds the closing wall 30 with respect to an envelope of a curve defined by the main development of the line of incision 14.

The protruding portion 76 can be defined by a convexity, protuberance, nose, beak, crest or other similar shape protruding outside, that is, developing forward with respect to the main development of the line of incision 14. For example, the protruding portion 76 can be defined by a circular arc or sector, or again by an elliptical portion or similar curve, for example an oval curved portion.

According to the present description, the mechanical element 28 is essentially tangent to the protruding portion 76 of the line of incision 14, where for the definition of "essentially tangent" or "tangent" and the advantageous technical effects connected to this disposition, the same considerations apply as those given for the forms of embodiment described using FIGS. 1-20.

According to some forms of embodiment, which can be combined with all the forms of embodiment described here, the protruding portion 76 has at least two characteristic sizes W1 and W2, which are defined here respectively as the maximum base width (W1) of the protruding portion 76 considered in a direction transverse, in particular orthogonal, to the median axis A, and the maximum length (W2) of the protruding portion 76, considered in a direction aligned longitudinally with the median axis A (see FIGS. 22 and 23).

According to possible variant forms of embodiment, it is provided that the base width W1 of the protruding portion 76 is comprised between about 4.8 mm and about 5.2 mm.

In particular, according to possible variants, the base width W1 of the protruding portion 76 is chosen so that its ratio with respect to the maximum width W of the closing element 12, and hence of the delivery aperture 15 defined by it (W1/W, see FIG. 23) is comprised between about 0.18 and about 0.23, in particular between about 0.19 and 0.22.

According to other possible variant forms of embodiment, it is provided that the length W2 of the protruding portion 76 is comprised between about 3.8 mm and about 4.2 mm.

In particular, according to some variants, the length W2 of the protruding portion 76 is chosen so that its ratio with respect to the radius R of the closing wall 30 (W2/R, see FIG. 23 in combination with FIG. 22) is comprised between about 0.15 and about 0.20, in particular between about 0.16 and 0.19. According to the present invention, the provision of the protruding portion 76 of the line of incision 14 as described above, also including its variants as discussed above, allows to advantageously solve the problems or disadvantages connected to venting/bursting phenomena, which for example could occur in the first steps of opening, when the gas is made to come out, in the case of carbonated drinks.

In particular, the presence of the protruding portion 76 allows to obtain an initial venting of the gas, preventing it from exiting violently from inside in a single solution and essentially instantaneously, which would damage the lid 10 and/or the container 11, deforming it.

Therefore, by providing the protruding portion 76 we obtain a first robust emergence of the gas, such as to limit venting/bursting effects during the subsequent opening steps and in any case such as would damage the lid 10 and/or the container 11; subsequently, continuing to open the closing element 12 as described above, the gas present in the top space of the container 11 under the lid 10 is allowed to escape in a controlled and safe manner. Essentially, a large part of the gas comes out when the closing element 12 has been lifted as far as in correspondence with about the center line of the lid 10.

Advantageously, moreover, the upward thrust from inside caused by the first "robust" venting of the gas, when the closing element 12 is opened in correspondence with the protruding portion 76, is added to the upward traction exerted by the user in lifting the opening lever 16, facilitating this operation, which can therefore be carried out with less effort since it is assisted and integrated by the thrust from inside by the gas. Therefore, the presence of the protruding portion 76, as well as solving possible venting/bursting problems, also creates a synergy with the other characteristics described here, which facilitate the opening of the closing element 12 by means of the opening lever 16.

It is clear that modifications and/or additions of parts may be made to the lid 10 for containers of substances and to the container 11 of substances comprising said lid as described heretofore, without departing from the field and scope of the present invention.

It is also clear that, although the present invention has been described with reference to some specific examples, a person of skill in the art shall certainly be able to achieve many other equivalent forms of lid 10 for containers of substances and to the container 11 of substances comprising said lid, having the characteristics as set forth in the claims and hence all coming within the field of protection defined thereby.

The invention claimed is:

1. Lid for a container made of metal and able to contain a substance, comprising:

a closing element defined by a line of incision provided with a front portion, an opening lever disposed astride the line of incision and comprising a fulcrum front end disposed at the front of the front portion, and an intermediate region provided with a flexible tongue attached to the closing element, a mechanical element configured to attach the flexible tongue mechanically to the closing element, and provided with an upper abutment head, which is configured to cooperate with said flexible tongue and is delimited peripherally by an external periphery, a central reinforcement and stiffening stud protruding from the closing element, wherein said mechanical element is disposed essentially tangent to the front portion of the line of incision such that said external periphery of the upper abutment head is aligned orthogonally to said line of incision;

wherein the front portion of the line of incision includes an outwardly protruding portion that extends toward the fulcrum front end of the opening lever to a zone where pulling and lifting of the lid starts;

wherein the line of incision includes a radius portion and is made on a closing wall of the closing element; and wherein the protruding portion has a length and a maximum base width and the closing element has a maximum width, wherein a first ratio of the maximum base width of the protruding portion to the maximum width of the closing element ranges from about 0.18 to about 0.23, and wherein a second ratio of the length of the protruding portion to the radius of the closing wall ranges from about 0.15 to about 0.20.

2. Lid as in claim 1, wherein said front portion is provided with a protruding concentrator segment having a cusp-like development.

3. Lid as in claim 2, wherein said front portion is rounded.

4. Lid as in claim 1, wherein said front portion has a circular development.

5. Lid as in claim 1, wherein said mechanical element is integral with the closing element.

6. Lid as in claim 1, provided with a peripheral annular groove that internally defines an annular peripheral bead, and wherein the fulcrum front end is disposed adjacent said annular peripheral bead.

7. Lid as in claim 1, wherein in cooperation with the mechanical element that attaches the flexible tongue to the closing element, a thickness of the flexible tongue and a thickness of the closing element are both reduced.

8. Lid as in claim 1, wherein the lid comprises an area of reduced thickness located near the front of the line of incision.

9. Lid as in claim 1, wherein the line of incision comprises two terminal branches.

10. Lid as in claim 9, wherein the line of incision comprises intermediate parallel segments rounded on one side with symmetrical curvilinear segments defined by said front portion and by said terminal branches.

11. Lid as in claim 9, comprising a reinforcement seating defined peripherally by a closed reinforcement edge that surrounds the closing element and the opening lever.

12. Lid as in claim 11, wherein said terminal branches are provided inside the reinforcement edge.

13. Lid as in claim 11, wherein the reinforcement edge is provided at the front with a front lowered zone, substantially in correspondence and aligned with the fulcrum front end of the opening lever.

14. Lid as in claim 1, comprising lateral centering ridges, the lateral centering ridges arranged to cooperate with and center the front lateral edge of the opening lever.

15. Lid as in claim 14, wherein said lateral centering ridges are aligned with respect to a median axis of the lid.

16. Lid as in claim 14, wherein said lateral centering ridges are disposed at the front of the opening lever, externally to the line of incision.

17. Lid as in claim 1, comprising lever positioning studs protruding from the closing element toward the opening lever and arranged to correctly position the opening lever with respect to the plane of the lid.

18. Lid as in claim 1, comprising a central stud protruding from the closing element and arranged to cooperate with the inside of a gripping ring of the opening lever, for the axial centering of the opening lever.

19. Lid as in claim 18, wherein said central stud is disposed along a median axis of the lid and is centered inside a hole of a gripping ring of the opening lever.

20. Lid as in claim 1, comprising a depression area made on the upper part of the opening lever, near the flexible tongue and the mechanical element associated thereto.

21. Lid as in claim 20, wherein said depression area provides a V-shaped zone cooperating with the opening lever during the making of the mechanical element.

22. Lid as in claim 1, comprising a central support ridge, protruding toward the opening lever, externally to the line of incision, to support and position the opening lever.

23. Lid as in claim 1, comprising a depression having a reinforcement edge, the reinforcement edge having a progressively decreasing depth.

24. Lid as in claim 1, wherein said mechanical element is essentially tangent to said protruding portion of said line of incision.

25. Container comprising the lid of claim 1.

26. Lid as in claim 1, wherein the line of incision is interrupted.

27. Lid as in claim 1, wherein the central reinforcement and stiffening stud is aligned with a median axis of the lid and disposed inside the line of incision defining the closing element.

* * * * *